US007031480B2

(12) United States Patent
Himori et al.

(10) Patent No.: US 7,031,480 B2
(45) Date of Patent: Apr. 18, 2006

(54) ELECTRET CONDENSER MICROPHONE

(75) Inventors: Tooru Himori, Sagamihara (JP); Yoshinobu Yasuno, Tokyo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 937 days.

(21) Appl. No.: 09/993,416

(22) Filed: Nov. 16, 2001

(65) Prior Publication Data

US 2002/0071579 A1 Jun. 13, 2002

(30) Foreign Application Priority Data

Nov. 21, 2000 (JP) ..... 2000-354453
Oct. 31, 2001 (JP) ..... 2001-334198

(51) Int. Cl.
*H04R 25/00* (2006.01)

(52) U.S. Cl. ..... 381/174; 381/191

(58) Field of Classification Search ..... 367/170, 367/181; 291/25.41; 381/191, 174, 111–116, 381/369, 178, 355, 190, 175, 173
See application file for complete search history.

(56) References Cited

U.S. PATENT DOCUMENTS 4,539,441 A * 9/1985 Eggert et al. ..... 381/323
5,097,515 A * 3/1992 Baba ..... 381/191
5,272,758 A * 12/1993 Isogami et al. ..... 381/191
6,512,833 B1 * 1/2003 Himori et al. ..... 381/174
6,594,369 B1 * 7/2003 Une ..... 381/174

* cited by examiner

*Primary Examiner*—Suhan Ni
(74) *Attorney, Agent, or Firm*—Pearne & Gordon LLP

(57) ABSTRACT

An electret condenser microphone has a casing member including a circular inlet portion and a cylindrical side portion integrally formed with each other, the side portion having a first section close to the inlet portion and a second section remote from the inlet portion and radially inwardly bent, a printed circuit board in the form of a circular shape and disposed in the casing member to be held in contact with the second section an electrode plate accommodated in a casing space defined by the casing member and the printed circuit board, an electrically connecting member intervening between and electrically connecting the printed circuit board and the electrode plate the electrically connecting member being partly disposed on and along the circumference of the printed circuit board, and a diaphragm located between the inlet portion and the electrode plate.

26 Claims, 12 Drawing Sheets

ELECTRET CONDENSER MICROPHONE

BACKGROUND OF THE INVENTION

1. Field of the Invention

The present invention relates to an electret condenser microphone available for various audio equipments such as a cellular phone, and more particularly to an electret condenser microphone equipped with a capacitor unit constituted by an electrode plate and a diaphragm to receive an acoustic wave to be converted to an acoustic signal indicative of the acoustic wave.

2. Description of the Related Art

Up until now, there have been proposed a wide variety of conventional electret condenser microphones each equipped with a capacitor unit constituted by an electrode plate and a diaphragm to receive an acoustic wave to be converted to an acoustic signal indicative of the acoustic wave.

The conventional electret condenser microphones of this type have so far been available for various audio equipments such as a cellular phone. One typical example of the conventional electret condenser microphones is exemplified and shown in FIGS. 11 and 12. The conventional electret condenser microphone 900 thus proposed comprises a casing member 910 including a circular inlet portion 912 constituting an electrode plate, and a cylindrical side portion 913 integrally formed with the inlet portion 912 and having a cylindrical inner surface 913*a*. The side portion 913 of the casing member 910 has a first section 915 close to the inlet portion 912 of the casing member 910, and a second section 916 remote from the inlet portion 912 of the casing member 910 and radially inwardly bent.

The conventional electret condenser microphone 900 further comprises a covering member 981 provided on the inlet portion 912 of the casing member 910, and a printed circuit board 920 disposed in the casing member 910 to be held in contact with the second section 916 of the side portion 913 of the casing member 910. The printed circuit board 920 has first and second surfaces 920*a* and 920*b* each having thereon a printed wiring.

The conventional electret condenser microphone 900 further comprises an electrically connecting member 950 in the form of an annular ring shape and provided on the first surface 920*a* of the printed circuit board 920 to be disposed on and along the circumference of the printed circuit board 920. The electrically connecting member 950 has a cylindrical outer surface 950*a* smaller in diameter than the inner surface 913*a* of the side portion 913 of the casing member 910. The inner surface 913*a* of the side portion 913 of the casing member 910 has a cylindrical surface portion opposing the outer surface 950*a* of the electrically connecting member 950.

The conventional electret condenser microphone 900 further comprises a diaphragm 970 made of an electret film and mounted on the electrically connecting member 950. The diaphragm 970 includes a peripheral portion 971 fixedly supported by the electrically connecting member 950, and a central portion 972 integrally formed with the peripheral portion 971 and radially inwardly extending from the peripheral portion 971 to be partly oscillatable with respect to the casing member 910.

The electrically connecting member 950 intervenes between the printed circuit board 920 and the peripheral portion 971 of the diaphragm 970 to have the printed circuit board 920 and the peripheral portion 971 of the diaphragm 970 electrically connected with each other.

The inlet portion 912 of the casing member 910 is formed with a plurality of acoustic apertures 917, 918 and 919 to have the acoustic wave transmitted to the diaphragm 970 through the covering member 981 and each of the acoustic apertures 917, 918 and 919 of the inlet portion 912 of the casing member 910.

The conventional electret condenser microphone 900 further comprises an electrically insulating spacer 980 intervening between the inlet portion 912 of the casing member 910 and the diaphragm 970 to have the inlet portion 912 of the casing member 910 and the diaphragm 970 spaced apart from each other at a predetermined space distance.

The inlet portion 912 of the casing member 910, i.e., the electrode plate, and the diaphragm 970 collectively constitute a capacitor unit 902 to generate an electrical capacitance corresponding to the space distance between the inlet portion 912 of the casing member 910 and the central portion 972 of the diaphragm 970 under the state that the acoustic wave is transmitted to the diaphragm 970 to have the central portion 972 of the diaphragm 970 partly oscillated with respect to the casing member 910.

The conventional electret condenser microphone 900 further comprises a signal converting unit 990 designed to convert the electrical capacitance generated by the capacitor unit 902 to the acoustic signal indicative of the acoustic wave transmitted to the diaphragm 970. The signal converting unit 990 includes a field effect transistor 991. The signal converting unit 990 is provided on the first surface 920*a* of the printed circuit board 920 to be surrounded by the electrically connecting member 950 with a sufficiently large space distance between the printed circuit board 920 and the diaphragm 970. The signal converting unit 990 is electrically connected to the inlet portion 912 of the casing member 910 through the printed wiring of the second surface 920*b* of the printed circuit board 920 and the side portion 913 of the casing member 910, and to the diaphragm 970 through the printed wiring of the first surface 920*a* of the printed circuit board 920 and the electrically connecting member 950.

The conventional electret condenser microphone, however, encounters such a problem that the sensitivity to the acoustic wave is decreased, resulting from the fact that the side portion 913 of the casing member 910 and the electrically connecting member 950 collectively constitute an unwanted capacitor unit to generate a stray capacitance corresponding to the area of the surface portion, opposing the outer surface 950*a* of the electrically connecting member 950, of the inner surface 913*a* of the side portion 913 of the casing member 910.

SUMMARY OF THE INVENTION

It is, therefore, an object of the present invention to provide an electret condenser microphone which can reduce the stray capacitance between the casing member and the electrically connecting member.

It is another object of the present invention to provide an electret condenser microphone which can increase the sensitivity to the acoustic wave.

In accordance with a first aspect of the present invention, there is provided an electret condenser microphone for receiving an acoustic wave to be converted to an acoustic signal indicative of said acoustic wave, comprising: a casing member having a center axis passing therethrough, the casing member including a circular inlet portion, and a cylindrical side portion integrally formed with the inlet portion of the casing member, the side portion of the casing member having a first section close to the inlet portion of the casing member, and a second section remote from the inlet portion of the casing member, the second section of the side portion of the casing member being radially inwardly bent toward the center axis of the casing member; a printed circuit board in the form of a circular shape and disposed in the casing member to be held in contact with the second section of the side portion of the casing member, the casing member and the printed circuit board collectively forming a cylindrical casing space; an electrode plate accommodated in the casing space of the casing member; an electrically connecting member intervening between the printed circuit board and the electrode plate to have the printed circuit board and the electrode plate electrically connected with each other, the electrically connecting member being partly disposed on and along the circumference of the printed circuit board; and a diaphragm located between the inlet portion of the casing member and the electrode plate to be spaced apart along the center axis of the casing member from the electrode plate at a predetermined space distance.

The electret condenser microphone may further comprise an electrically insulating member accommodated in the casing space of the casing member and provided on the printed circuit board, in which the electrode plate is mounted on the electrically insulating member and retained by the electrically insulating member.

The electret condenser microphone may further comprise a diaphragm supporting member accommodated in the casing space of the casing member and supported by the inlet portion of the casing member, in which the diaphragm is mounted on the diaphragm supporting member and supported by the diaphragm supporting member.

The electret condenser microphone may further comprise an electrically insulating spacer intervening between the electrode plate and the diaphragm to have the electrode plate and the diaphragm spaced apart from each other at the predetermined space distance.

The electret condenser microphone may further comprise a covering member provided on the inlet portion of the casing member.

The electrode plate and the diaphragm may collectively constitute a capacitor unit to generate an electrical capacitance corresponding to the space distance between the electrode plate and the diaphragm under the state that the acoustic wave is transmitted to the diaphragm to have the diaphragm partly oscillated along the center axis of the casing member with respect to the casing member.

The electret condenser microphone may further comprise a signal converting unit for converting the electrical capacitance generated by the capacitor unit to the acoustic signal indicative of the acoustic wave transmitted to the diaphragm.

The signal converting unit may be accommodated in the casing space of the casing member and provided on the printed circuit board to be electrically connected to the electrode plate and the diaphragm, respectively.

The signal converting unit may include a field effect transistor, a chip capacitor and a resistor.

The electrode plate may have thereon an electret film opposing and spaced apart along the center axis of the casing member from the inlet portion of the casing member.

The diaphragm may be made of an electret film.

The electrically connecting member may be in the form of a column shape and have first and second end surfaces under the state that the first end surface is held in contact with the electrode plate, and the second end surface is held in contact with the printed circuit board.

The electrically connecting member may be in the form of a channel shape and have first and second end surfaces under the state that the first end surface is held in contact with the electrode plate, and the second end surface is held in contact with the printed circuit board.

In accordance with a second aspect of the present invention, there is provided an electret condenser microphone for receiving an acoustic wave to be converted to an acoustic signal indicative of said acoustic wave, comprising: a casing member having a center axis passing therethrough, the casing member including a circular inlet portion, and a cylindrical side portion integrally formed with the inlet portion of the casing member, the side portion of the casing member having a first section close to the inlet portion of the casing member, and a second section remote from the inlet portion of the casing member, the second section of the side portion of the casing member being radially inwardly bent toward the center axis of the casing member, a printed circuit board in the form of a circular shape and disposed in the casing member to be held in contact with the second section of the side portion of the casing member, the casing member and the printed circuit board collectively forming a cylindrical casing space; an electrode plate accommodated in the casing space of the casing member, a plurality of electrically connecting members each intervening between the printed circuit board and the electrode plate to have the printed circuit board and the electrode plate electrically connected with each other, the electrically connecting members being partly disposed on and along the circumference of the printed circuit board; and a diaphragm located between the inlet portion of the casing member and the electrode plate to be spaced apart along the center axis of the casing member from the electrode plate at a predetermined space distance.

Each of the electrically connecting members may be in the form of a column shape and have first and second end surfaces under the state that the first end surface is held in contact with the electrode plate, and the second end surface is held in contact with the printed circuit board.

Each of the electrically connecting members may be in the form of a channel shape and have first and second end surfaces under the state that the first end surface is held in contact with the electrode plate, and the second end surface is held in contact with the printed circuit board.

BRIEF DESCRIPTION OF THE DRAWINGS

The features and advantages of an electret condenser microphone according to the present invention will more clearly be understood from the following description taken in conjunction with the accompanying drawings in which.

DESCRIPTION OF THE PREFERRED EMBODIMENTS

Figure 1:
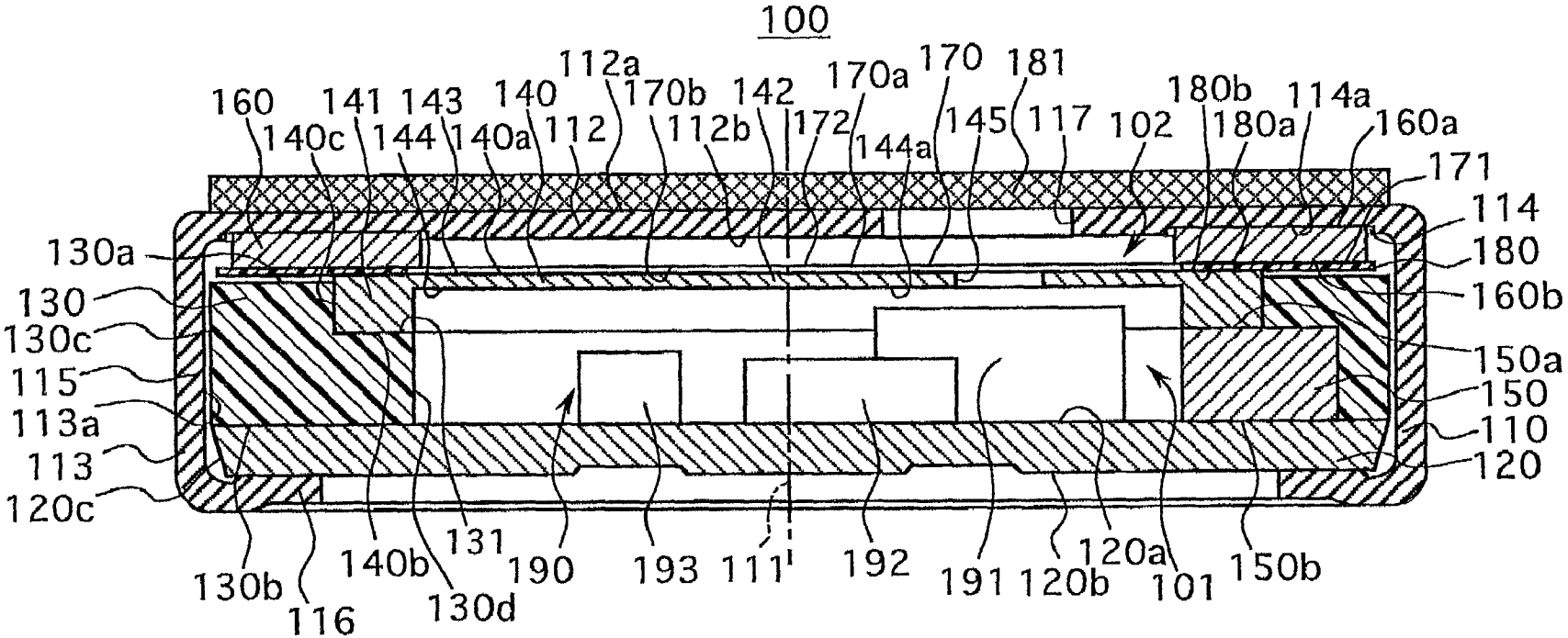
FIG. 1 is a cross-sectional view, taken along the line A—A of FIG. 2, of a first embodiment of the electret condenser microphone according to the present invention.
Figure 2:
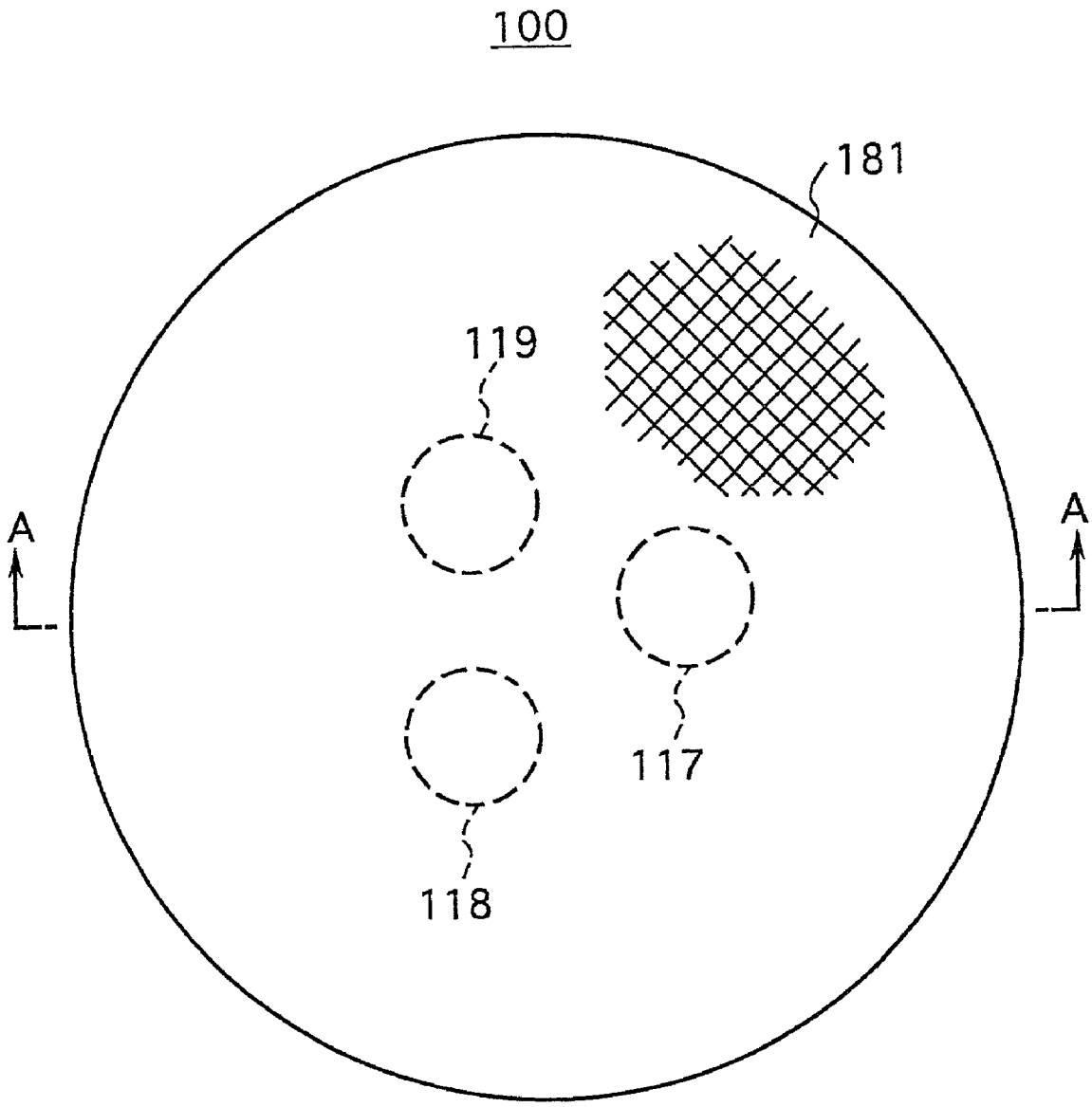
FIG. 2 is a plan view of the electret condenser microphone shown in FIG. 1.
Figure 3:
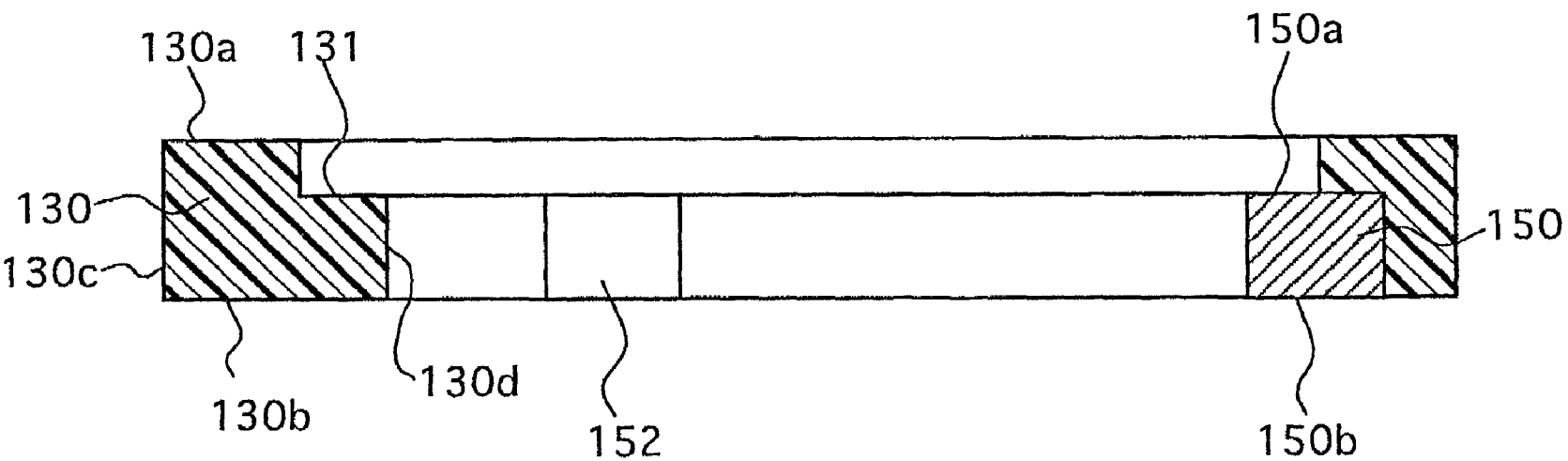
FIG. 3 is a cross-sectional view, taken along the line B—B of FIG. 4, of an electrically insulating member and a plurality of electrically connecting members each forming part of the electret condenser microphone shown in FIG. 1.

The first preferred embodiment of the electret condenser microphone according to the present invention will now be described in detail in accordance with the accompanying drawings.

Referring now to the drawings, in particular to FIGS. 1 to 4, there is shown the first preferred embodiment of the electret condenser microphone according to the present invention. The electret condenser microphone 100 is designed to receive an acoustic wave to be converted to an acoustic signal indicative of the acoustic wave. The electret condenser microphone 100 comprises a casing member 110 in the form of a cylindrical shape and having a center axis 111 passing therethrough. The casing member 110 includes a circular inlet portion 112 having first and second circular surfaces 112*a* and 112*b*, and a cylindrical side portion 113 integrally formed with the inlet portion 112 of the casing member 110 and having a cylindrical inner surface 113*a* connected to the second surface 112*b* of the inlet portion 112 of the casing member 110.

The inlet portion 112 of the casing member 110 is formed with an annular groove 114 open at the second surface 112*b* thereof and having a bottom surface 114*a*. The side portion 113 of the casing member 110 has a first section 115 close to the inlet portion 112 of the casing member 110, and a second section 116 remote from the inlet portion 112 of the casing member 110. The second section 116 of the side portion 113 of the casing member 110 is radially inwardly bent toward the center axis 111 of the casing member 110. The casing member 110 is made of an electrically conductive material.

The electret condenser microphone 100 further comprises a printed circuit board 120 in the form of a circular shape and disposed in the casing member 110 to be held in coaxial alignment with the casing member 110. The printed circuit board 120 has a first circular surface 120*a* opposing and spaced apart along the center axis 111 of the casing member 110 from the second surface 112*b* of the inlet portion 112 of the casing member 110, a second circular surface 120*b* held in contact with the second section 116 of the side portion 113 of the casing member 110, and a peripheral surface 120*c* spaced apart from the inner surface 113*a* of the side portion 113 of the casing member 110. Each of the first and second circular surfaces 120*a* and 120*b* of the printed circuit board 120 has thereon a printed wiring. The casing member 110 and the printed circuit board 120 collectively form a cylindrical casing space 101.

The electret condenser microphone 100 further comprises an electrically insulating member 130 in the form of an annular ring shape and accommodated in the casing space 101 of the casing member 110 to be held in coaxial alignment with the casing member 110. The electrically insulating member 130 is provided on the first surface 120*a* of the printed circuit board 120. The electrically insulating member 130 has a first annular surface 130*a* opposing and spaced apart along the center axis 111 of the casing member 110 from the second surface 112*b* of the inlet portion 112 of the casing member 110, a second annular surface 130*b* held in contact with the first surface 120*a* of the printed circuit board 120, a cylindrical outer surface 130*c* smaller in diameter than the inner surface 113*a* of the side portion 113 of the casing member 110, and an inner surface 130*d* in the form of a cylindrical shape.

The first and inner surfaces 130*a* and 130*d* of the electrically insulating member 130 are connected together to form an inner corner close to the center axis 111 of the casing member 110. The electrically insulating member 130 is formed at the inner corner thereof with an annular ledge 131. The electrically insulating member 130 is disposed on and along the circumference of the printed circuit board 120 under the state that the inner surface 113*a* of the side portion 113 of the casing member 110 opposes the outer surface 130*c* of the electrically insulating member 130. The electrically insulating member 130 is made of an electrically insulating material.

The electret condenser microphone 100 further comprises an electrode plate 140 in the form of a circular shape and accommodated in the casing space 101 of the casing member 110 to be held in coaxial alignment with the casing member 110. The electrode plate 140 is mounted on the electrically insulating member 130. The electrode plate 140 includes a peripheral portion 141 received in the annular ledge 131 of the electrically insulating member 130 and securely retained by the electrically insulating member 130, and a central portion 142 integrally formed with the peripheral portion 141 of the electrode plate 140 and radially inwardly extending from the peripheral portion 141 of the electrode plate 140.

The electrode plate 140 has a first circular surface 140*a* opposing and spaced apart along the center axis 111 of the casing member 110 from the second surface 112*b* of the inlet portion 112 of the casing member 110, a second circular surface 140*b* opposing and spaced apart along the center axis 111 of the casing member 110 from the first surface 120*a* of the printed circuit board 120, and a peripheral surface 140*c* spaced apart from the inner surface 113*a* of the side portion 113 of the casing member 110. The first surface 140*a* of the electrode plate 140 has thereon an electret film 143 opposing and spaced apart along the center axis 111 of the casing member 110 from the second surface 112*b* of the inlet portion 112 of the casing member 110. The electret condenser microphone 100 thus constructed is generally called "back electret type of electret condenser microphone". The electrode plate 140 is formed with a circular cavity 144 open at the second surface thereof and having a bottom surface 144*a*. The electrode plate 140 is made of an electrically conductive material.

Figure 4:
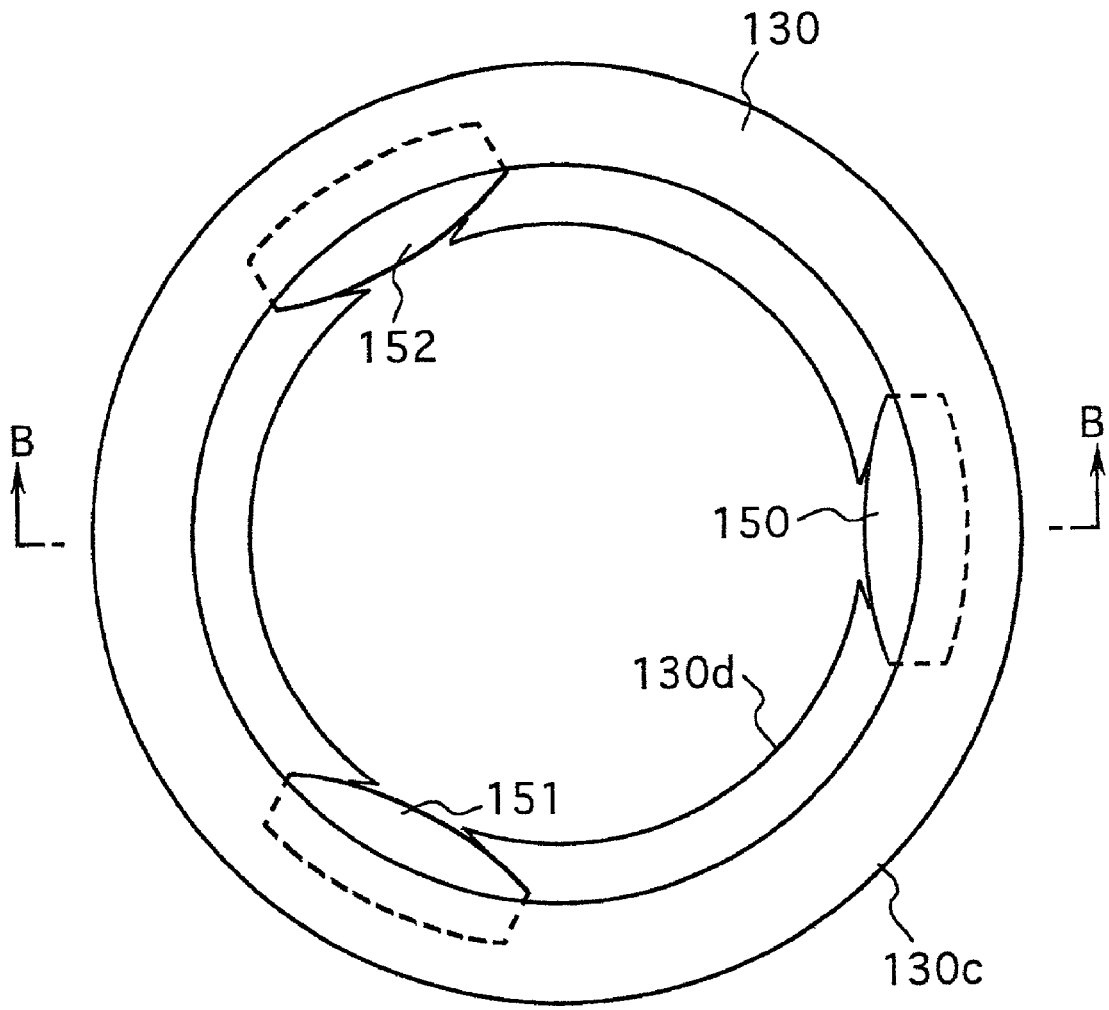
FIG. 4 is a plan view of the electrically insulating member and the plurality of electrically connecting members shown in FIG. 3.

The electret condenser microphone 100 further comprises a plurality of electrically connecting members 150, 151 and 152 each intervening between the printed circuit board 120 and the peripheral portion 141 of the electrode plate 140 to have the printed circuit board 120 and the peripheral portion 141 of the electrode plate 140 electrically connected with each other. The electrically connecting members 150, 151 and 152 are partly disposed on and along the circumference of the printed circuit board 120 to be equidistantly spaced apart from each other as shown in FIG. 4.

Figure 11:
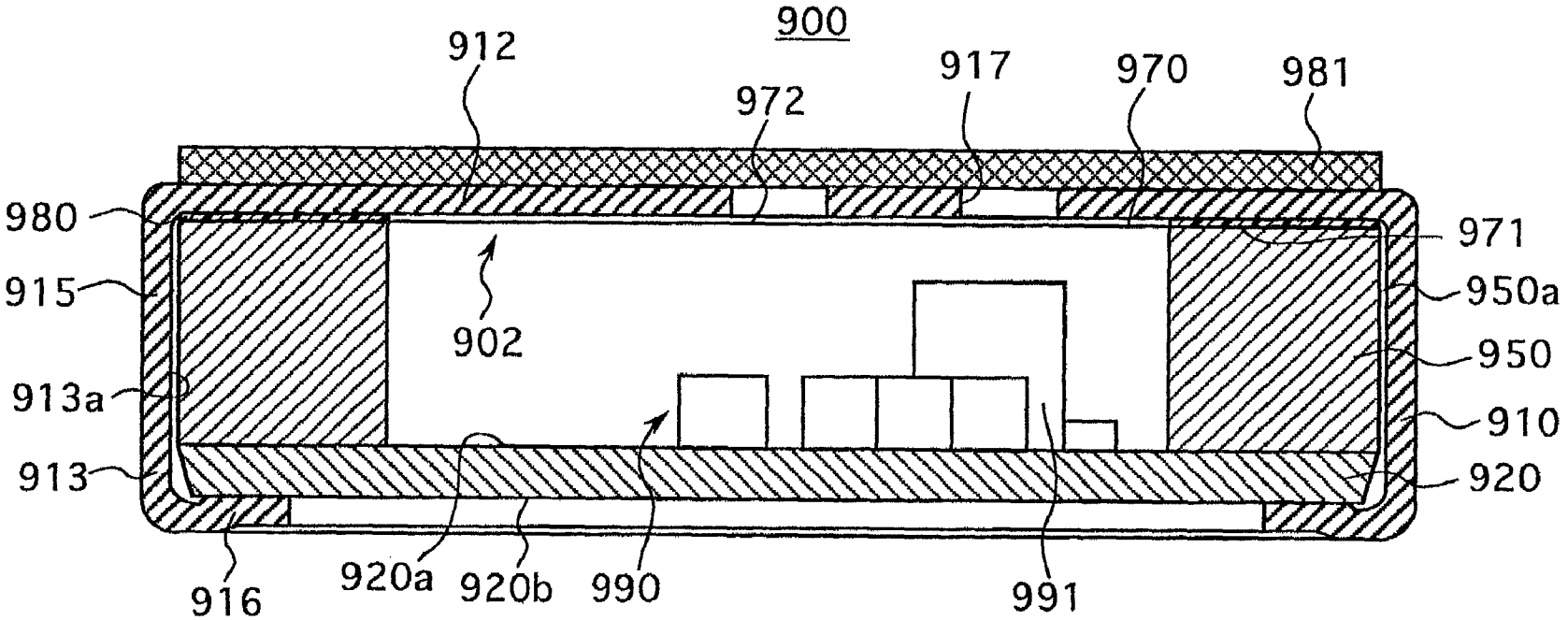
FIG. 11 PRIOR ART
FIG. 11 is a cross-sectional view, taken along the line E—E of FIG. 12, of a conventional electret condenser microphone.
Figure 12:
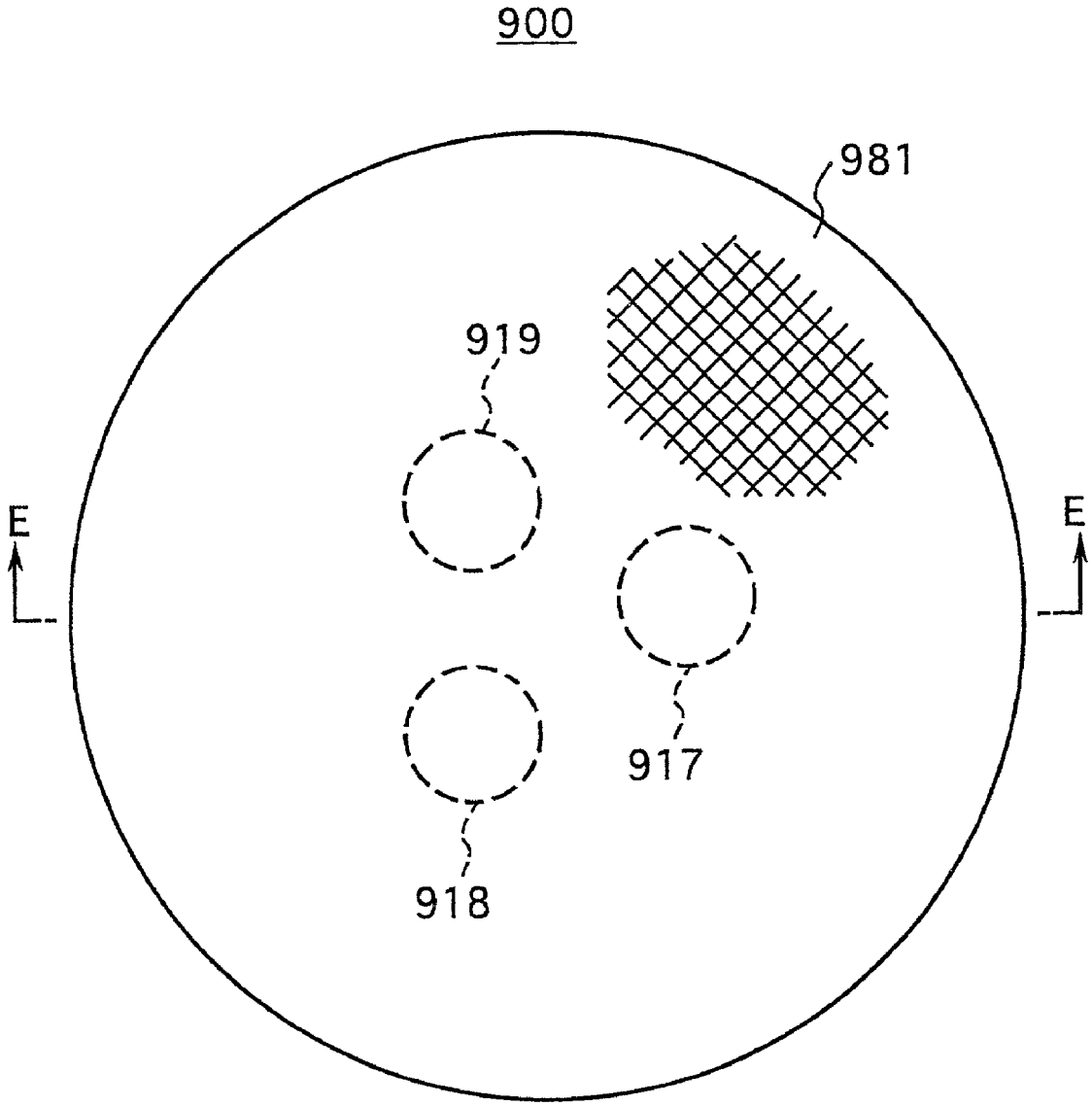
FIG.12 PRIOR ART
FIG. 12 is a plan view of the conventional electret condenser microphone shown in FIG. 11.

In the first embodiment of the electret condenser microphone according to the present invention, the inner surface 113*a* of the side portion 113 of the casing member 110 has a plurality of surface portions opposing the electrically connecting members 150, 151 and 152 respectively. The collective area of the surface portions, opposing the electrically connecting members 150, 151 and 152 respectively, of the inner surface 113*a* of the side portion 113 of the casing member 110 is smaller than the area of the surface portion, opposing the electrically connecting member 950, of the inner surface 913*a* of the side portion 913 of the casing member 910 of the conventional electret condenser microphone 900 shown in FIG. 11.

Each of the electrically connecting members 150, 151 and 152 is in the form of a column shape and partly embedded in the electrically insulating member 130. Each of the electrically connecting members 150, 151 and 152 is in the form of an approximate circular shape in cross-section taken along the plane perpendicular to the center axis passing therethrough. Each of the electrically connecting members 150, 151 and 152 has a first end surface 150*a*, 151*a* and 152*a*, and a second end surface 150*b*, 151*b* and 152*b*. Each of the electrically connecting members 150, 151 and 152 is fixedly supported by the electrically insulating member 130 under the state that the first end surface 150*a*, 151*a* and 152*a* is held in contact with the second surface 140*b* of the electrode plate 140, and the second end surface 150*b*, 151*b* and 152*b* is held in contact with the first surface 120*a* of the printed circuit board 120. Each of the electrically connecting members 150, 151 and 152 is made of an electrically conductive material.

While it has been described in the above that each of the electrically connecting members 150, 151 and 152 is in the form of an approximate circular shape in cross-section taken along the plane perpendicular to the center axis passing therethrough, each of the electrically connecting members 150, 151 and 152 may be replaced by an electrically connecting member in the form of a polygonal shape in cross-section taken along the plane perpendicular to the center axis passing therethrough according to the present invention.

Though the electret condenser microphone 100 has been described in the above as comprising a plurality of electrically connecting members 150, 151 and 152 partly disposed on and along the circumference of the printed circuit board 120, the plurality of electrically connecting members 150, 151 and 152 may be replaced by a single electrically connecting member 150 partly disposed on and along the circumference of the printed circuit board 120 according to the present invention. The construction of the single electrically connecting member 150 is entirely the same as that of each of the electrically connecting members 150, 151 and 152. Detailed description about the single electrically connecting member 150 will therefore be omitted hereinafter.

The electret condenser microphone 100 further comprises a diaphragm supporting member 160 in the form of an annular ring shape and accommodated in the casing space 101 of the casing member 110 to be held in coaxial alignment with the casing member 110. The diaphragm supporting member 160 is received in the annular groove 114 of the inlet portion 112 of the casing member 110 and fixedly supported by the inlet portion 112 of the casing member 110. The diaphragm supporting member 160 has a first annular surface 160*a* held in contact with the bottom surface 114*a* of the annular groove 114 of the inlet portion 112 of the casing member 110, and a second annular surface 160*b* opposing and spaced apart along the center axis 111 of the casing member 110 from the first surface 120*a* of the printed circuit board 120. The diaphragm supporting member 160 is made of an electrically conductive material.

The electret condenser microphone 100 further comprises a diaphragm 170 in the form of a circular shape and located between the inlet portion 112 of the casing member 110 and the electrode plate 140 to be held in coaxial alignment with the casing member 110. The diaphragm 170 is mounted on the diaphragm supporting member 160. The diaphragm 170 includes a peripheral portion 171 provided on the second surface 160*b* of the diaphragm supporting member 160 and fixedly supported by the diaphragm supporting member 160, and a central portion 172 integrally formed with the peripheral portion 171 of the diaphragm 170 and radially inwardly extending from the peripheral portion 171 of the diaphragm 170 to be partly oscillatable along the center axis 111 of the casing member 110 with respect to the casing member 110.

The diaphragm 170 has a first circular surface 170*a* opposing and spaced apart along the center axis 111 of the casing member 110 from the second surface 112*b* of the inlet portion 112 of the casing member 110, and a second circular surface 170*b* opposing and spaced apart along the center axis 111 of the casing member 110 from the first surface 140*a* of the electrode plate 140 at a predetermined space distance. The diaphragm 170 is made of an electrically conductive material.

The central portion 142 of the electrode plate 140 is formed with a through bore 145 open at the first and bottom surfaces 140*a* and 144*a* thereof to ensure that the central portion 172 of the diaphragm 170 is partly oscillatable along the center axis 111 of the casing member 110 with respect to the casing member 110.

The electret condenser microphone 100 further comprises an electrically insulating spacer 180 in the form of an annular ring shape and intervening between the first surface 140*a* of the electrode plate 140 and the second surface 170*b* of the diaphragm 170 to have the first surface 140*a* of the electrode plate 140 and the second surface 170*b* of the diaphragm 170 spaced apart from each other at the predetermined space distance. The electrically insulating spacer 180 has a first annular surface 180*a* held in contact with the second surface 170*b* of the diaphragm 170, and a second annular surface 180*b* partly held in contact with the first surface 140*a* of the electrode plate 140 and partly opposing and spaced apart along the center axis 111 of the casing member 110 from the first surface 130*a* of the electrically insulating member 130. The electrically insulating spacer 180 is made of an electrically insulating material.

The electrode plate 140 and the diaphragm 170 collectively constitute a capacitor unit 102 to generate an electrical capacitance corresponding to the space distance between the electrode plate 140 and the central portion 172 of the diaphragm 170 under the state that the acoustic wave is transmitted to the diaphragm 170 to have the central portion 172 of the diaphragm 170 partly oscillated along the center axis 111 of the casing member 110 with respect to the casing member 110.

The electret condenser microphone 100 further comprises a covering member 181 in the form of a circular shape and provided on the first surface 112*a* of the inlet portion 112 of the casing member 110. The covering member 181 is made of a cloth.

The inlet portion 112 of the casing member 110 is formed with a plurality of acoustic apertures 117, 118 and 119 each open at the first and second surfaces 112*a* and 112*b* thereof to have the acoustic wave transmitted to the diaphragm 170 through the covering member 181 and each of the acoustic apertures 117, 118 and 119 of the inlet portion 112 of the casing member 110.

The electret condenser microphone 100 further comprises a signal converting unit 190 designed to convert the electrical capacitance generated by the capacitor unit 102 to the acoustic signal indicative of the acoustic wave transmitted to the diaphragm 170. The signal converting unit 190 is accommodated in the casing space 101 of the casing member 110 and provided on the first surface 120*a* of the printed circuit board 120 to be surrounded by the electrically insulating member 130 with a sufficiently large space distance between the printed circuit board 120 and the diaphragm 170. The fact that the signal converting unit 190 is provided on the first surface 120*a* of the printed circuit board 120 to be surrounded by the electrically insulating member 130 leads to the fact that the electrically connecting members 150, 151 and 152 are partly disposed along the circumference surrounding the signal converting unit 190.

The signal converting unit 190 includes a field effect transistor 191, a chip capacitor 192 and a resistor 193. The field effect transistor 191 is the largest in height in the signal converting unit 190 and extends to the circular cavity 144 of the electrode plate 140. The signal converting unit 190 is electrically connected to the electrode plate 140 through the printed wiring of the first surface 120*a* of the printed circuit board 120 and each of the electrically connecting members 150, 151 and 152, and to the diaphragm 170 through the printed wiring of the second surface 120*b* of the printed circuit board 120, the casing member 110 and the diaphragm supporting member 160.

As will be seen from the foregoing description, the first embodiment of the electret condenser microphone according to the present invention makes it possible to reduce the stray capacitance between the casing member and the electrically connecting member, thereby increasing the sensitivity to the acoustic wave, resulting from the fact that the electrically connecting members are partly disposed on and along the circumference of the printed circuit board.

While the electret condenser microphone 100 has been described in the above as comprising an electrode plate 140 made of an electrically conductive material and having an electret film 143 on the first surface 140*a* thereof, and a diaphragm 170 made of an electrically conductive material as shown in FIG. 1, the electrode plate 140 and the diaphragm 170 may be replaced by an electrode plate made of an electrically conductive material and a diaphragm made of an electret film according to the present invention.

Figure 5:
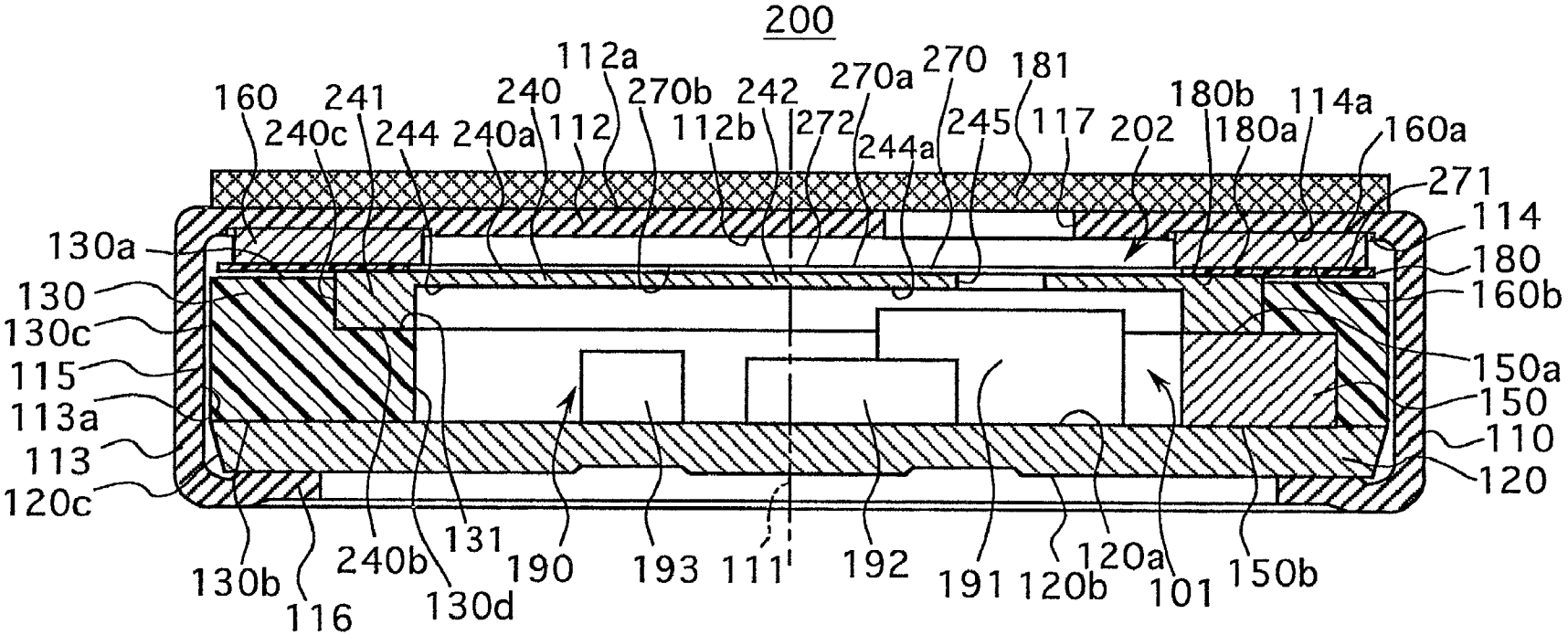
FIG. 5 is a cross-sectional view, taken along the line A—A of FIG. 2, similar to FIG. 1 but showing a second embodiment of the electret condenser microphone according to the present invention.

The second embodiment directed to an electrode plate made of an electrically conductive material and a diaphragm made of an electret film is shown in FIG. 5.

In FIG. 5, the electret condenser microphone 200 comprises an electrode plate 240 in the form of a circular shape and accommodated in the casing space 101 of the casing member 110 to be held in coaxial alignment with the casing member 110.

The electrode plate 240 is mounted on the electrically insulating member 130. The electrode plate 240 includes a peripheral portion 241 received in the annular ledge 131 of the electrically insulating member 130 and securely retained by the electrically insulating member 130, and a central portion 242 integrally formed with the peripheral portion 241 of the electrode plate 240 and radially inwardly extending from the peripheral portion 241 of the electrode plate 240.

The electrode plate 240 has a first circular surface 240*a* opposing and spaced apart along the center axis 111 of the casing member 110 from the second surface 112*b* of the inlet portion 112 of the casing member 110, a second circular surface 240*b* opposing and spaced apart along the center axis 111 of the casing member 110 from the first surface 120*a* of the printed circuit board 120, and a peripheral surface 240*c* spaced apart from the inner surface 113*a* of the side portion 113 of the casing member 110. The electrode plate 240 is formed with a circular cavity 244 open at the second surface 240*b* thereof and having a bottom surface 244*a*. The electrode plate 240 is made of an electrically conductive material.

The electret condenser microphone 200 farther comprises a diaphragm 270 in the form of a circular shape and located between the inlet portion 112 of the casing member 110 and the electrode plate 140 to be held in coaxial alignment with the casing member 110. The diaphragm 270 is mounted on the diaphragm supporting member 160. The diaphragm 270 includes a peripheral portion 271 provided on the second surface 160*b* of the diaphragm supporting member 160 and fixedly supported by the diaphragm supporting member 160, and a central portion 272 integrally formed with the peripheral portion 271 of the diaphragm 270 and radially inwardly extending from the peripheral portion 271 of the diaphragm 270 to be partly oscillatable along the center axis 111 of the casing member 110 with respect to the casing member 110.

The diaphragm 270 has a first circular surface 270*a* opposing and spaced apart along the center axis 111 of the casing member 110 from the second surface 112*b* of the inlet portion 112 of the casing member 110, and a second circular surface 270*b* opposing and spaced apart along the center axis 111 of the casing member 110 from the first surface 240*a* of the electrode plate 240 at a predetermined space distance. The diaphragm 270 is made of an electret film. The electret condenser microphone 200 thus constructed is generally called "foil electret type of electret condenser microphone".

The central portion 242 of the electrode plate 240 is formed with a through bore 245 open at the first and bottom surfaces 240*a* and 244*a* thereof to ensure that the central portion 272 of the diaphragm 270 is partly oscillatable along the center axis 111 of the casing member 110 with respect to the casing member 110.

The electrode plate 240 and the diaphragm 270 collectively constitute a capacitor unit 202 to generate an electrical capacitance corresponding to the space distance between the electrode plate 240 and the central portion 272 of the diaphragm 270 under the state that the acoustic wave is transmitted to the diaphragm 270 to have the central portion 272 of the diaphragm 270 partly oscillated along the center axis 111 of the casing member 110 with respect to the casing member 110.

The above description of the second embodiment has been made only about the electrode plate 240 and the diaphragm 270 different from those of the first embodiment, but has not been directed to the casing member 110, the printed circuit board 120, the electrically insulating member 130, the electrically connecting members 150, 151 and 152, the diaphragm supporting member 160, the electrically insulating spacer 180, the covering member 181 and the signal converting unit 190 which are entirely the same as those of the first embodiment. Detailed description about the casing member 110, the printed circuit board 120, the electrically insulating member 130, the electrically connecting members 150, 151 and 152, the diaphragm supporting member 160, the electrically insulating spacer 180, the covering member 181 and the signal converting unit 190 will therefore be omitted hereinafter.

It is understood that the second embodiment of the electret condenser microphone according to the present invention has an advantage and effect the same as that of the first embodiment of the electret condenser microphone according to the present invention.

Referring now to the drawings, in particular to FIGS. 6 to 9, there is shown the third preferred embodiment of the electret condenser microphone according to the present invention. The electret condenser microphone 300 is designed to receive an acoustic wave to be converted to an acoustic signal indicative of the acoustic wave. The electret condenser microphone 300 comprises a casing member 310 in the form of a cylindrical shape and having a center axis 311 passing therethrough. The casing member 310 includes a circular inlet portion 312 having first and second circular surfaces 312*a* and 312*b*, and a cylindrical side portion 313 integrally formed with the inlet portion 312 of the casing member 310 and having a cylindrical inner surface 313*a* connected to the second surface 312*b* of the inlet portion 312 of the casing member 310.

The inlet portion 312 of the casing member 310 is formed with an annular groove 314 open at the second surface 312*b* thereof and having a bottom surface 314*a*. The side portion 313 of the casing member 310 has a first section 315 close to the inlet portion 312 of the casing member 310, and a second section 316 remote from the inlet portion 312 of the casing member 310. The second section 316 of the side portion 313 of the casing member 310 is radially inwardly bent toward the center axis 311 of the casing member 310. The casing member 310 is made of an electrically conductive material.

The electret condenser microphone 300 farther comprises a printed circuit board 320 in the form of a circular shape and disposed in the casing member 310 to be held in coaxial alignment with the casing member 310. The printed circuit board 320 has a first circular surface 320*a* opposing and spaced apart along the center axis 311 of the casing member 310 from the second surface 312*b* of the inlet portion 312 of the casing member 310, a second circular surface 320*b* held in contact with the second section 316 of the side portion 313 of the casing member 310, and a peripheral surface 32*c* spaced apart from the inner surface 313*a* of the side portion 313 of the casing member 310. Each of the first and second circular surfaces 320*a* and 320*b* of the printed circuit board 320 has thereon a printed wiring. The casing member 310 and the printed circuit board 320 collectively form a cylindrical casing space 301.

The electret condenser microphone 300 further comprises an electrically insulating member 330 in the form of an annular ring shape and accommodated in the casing space 301 of the casing member 310 to be held in coaxial alignment with the casing member 310. The electrically insulating member 330 is provided on the first surface 320*a* of the printed circuit board 320. The electrically insulating member 330 has a first annular surface 330*a* opposing and spaced apart along the center axis 311 of the casing member 310 from the second surface 312*b* of the inlet portion 312 of the casing member 310, a second annular surface 330*b* held in contact with the first surface 320*a* of the printed circuit board 320, a cylindrical outer surface 330*c* smaller in diameter than the inner surface 313*a* of the side portion 313 of the casing member 310, and an inner surface 330*d* in the form of a truncated conical shape and tapered toward the second surface 312*b* of the inlet portion 312 of the casing member 310.

The first and inner surfaces 330*a* and 330*d* of the electrically insulating member 330 are connected together to form an inner corner close to the center axis 311 of the casing member 310. The electrically insulating member 330 is formed at the inner corner thereof with an annular ledge 331. The electrically insulating member 330 is disposed on and along the circumference of the printed circuit board 320 under the state that the inner surface 313*a* of the side portion 313 of the casing member 310 opposes the outer surface 330*c* of the electrically insulating member 330. The electrically insulating member 330 is made of an electrically insulating material.

The electret condenser microphone 300 further comprises an electrode plate 340 in the form of a circular shape and accommodated in the casing space 301 of the casing member 310 to be held in coaxial alignment with the casing member 310. The electrode plate 340 is mounted on the electrically insulating member 330. The electrode plate 340 includes a peripheral portion 341 received in the annular ledge 331 of the electrically insulating member 330 and securely retained by the electrically insulating member 330, and a central portion 342 integrally formed with the peripheral portion 341 of the electrode plate 340 and radially inwardly extending from the peripheral portion 341 of the electrode plate 340.

The electrode plate 340 has a first circular surface 340*a* opposing and spaced apart along the center axis 311 of the casing member 310 from the second surface 312*b* of the inlet portion 312 of the casing member 310, a second circular surface 340*b* opposing and spaced apart along the center axis 311 of the casing member 310 from the first surface 320*a* of the printed circuit board 320, and a peripheral surface 340*c* spaced apart from the inner surface 313*a* of the side portion 313 of the casing member 310. The first surface 340*a* of the electrode plate 340 has thereon an electret film 343 opposing and spaced apart along the center axis 311 of the casing member 310 from the second surface 312*b* of the inlet portion 312 of the casing member 310. The electret condenser microphone 300 thus constructed is generally called "back electret type of electret condenser microphone". The electrode plate 340 is formed with a circular cavity 344 open at the second surface thereof and having a bottom surface 344*a*. The electrode plate 340 is made of an electrically conductive material.

Figure 9:
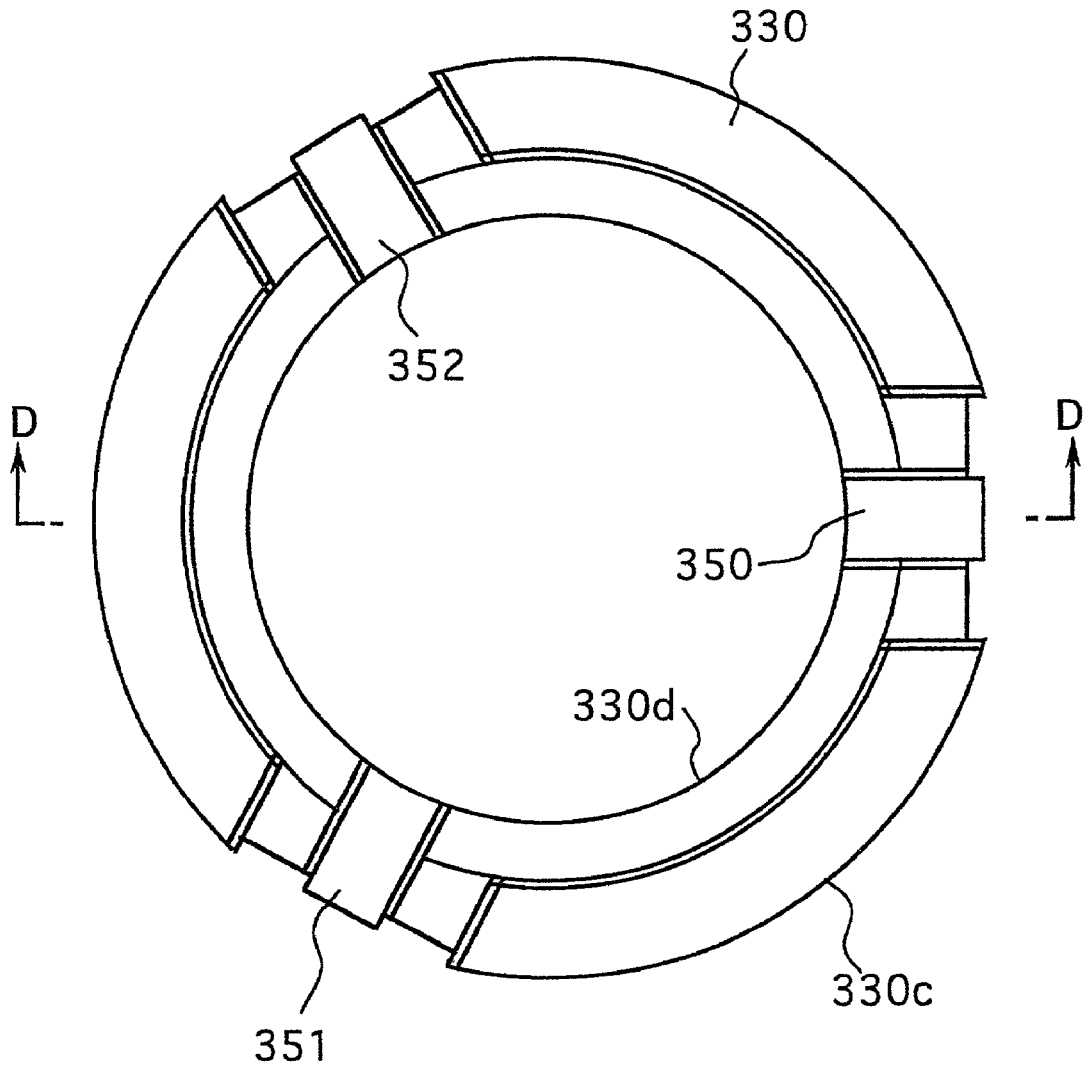
FIG. 9 is a plan view of the electrically insulating member and the plurality of electrically connecting members shown in FIG. 8.

The electret condenser microphone 300 further comprises a plurality of electrically connecting members 350, 351 and 352 each intervening between the printed circuit board 320 and the peripheral portion 341 of the electrode plate 340 to have the printed circuit board 320 and the peripheral portion 341 of the electrode plate 340 electrically connected with each other. The electrically connecting members 350, 351 and 352 are partly disposed on and along the circumference of the printed circuit board 320 to be equidistantly spaced apart from each other as shown in FIG. 9.

In the third embodiment of the electret condenser microphone according to the present invention, the inner surface 313*a* of the side portion 313 of the casing member 310 has a plurality of surface portions opposing the electrically connecting members 350, 351 and 352 respectively. The collective area of the surface portions, opposing the electrically connecting members 350, 351 and 352 respectively, of the inner surface 313*a* of the side portion 313 of the casing member 310 is smaller than the area of the surface portion, opposing the electrically connecting member 950, of the inner surface 913*a* of the side portion 913 of the casing member 910 of the conventional electret condenser microphone 900 shown in FIG. 11.

Each of the electrically connecting members 350, 351 and 352 is in the form of a channel shape and has a first portion 350*c*, 351*c* and 352*c* provided on the inner surface 330*d* of the electrically insulating member 330, a second portion 350*d*, 351*d* and 352*d* integrally formed with the first portion 350*c*, 351*c* and 352*c* and radially outwardly extending from one end of the first portion 350*c*, 351*c* and 35*c*, and a third portion 350*e*, 351*e* and 352*e* integrally formed with the first portion 350*c*, 351*c* and 352*c* and radially outwardly extending from the other end of the first portion 350*c*, 351*c* and 352*c*. Each of the electrically connecting members 350, 351 and 352 has a first end surface 350*a*, 351*a* and 352*a*, and a second end surface 350*b*, 351*b* and 352*b*. Each of the electrically connecting members 350,351 and 352 is fixedly supported by the electrically insulating member 330 under the state that the first end surface 350*a*, 351*a* and 351*a* is held in contact with the second surface 340*a* of the electrode plate 340, and the second end surface 350*b*, 351*b* and 352*b* is held in contact with the first surface 320*a* of the printed circuit board 320. Each of the electrically connecting members 350, 351 and 352 is made of an electrically conductive material.

While the electret condenser microphone 300 has been described in the above as comprising a plurality of electrically connecting members 350, 351 and 352 partly disposed on and along the circumference of the printed circuit board 320, the plurality of electrically connecting members 350, 351 and 352 may be replaced by a single electrically connecting member 350 partly disposed on and along the circumference of the printed circuit board 320 according to the present invention. The construction of the single electrically connecting member 350 is entirely the same as that of each of the electrically connecting members 350, 351 and 352. Detailed description about the single electrically connecting member 350 will therefore be omitted hereinafter.

The electret condenser microphone 300 further comprises a diaphragm supporting member 360 in the form of an annular ring shape and accommodated in the casing space 301 of the casing member 310 to be held in coaxial alignment with the casing member 310. The diaphragm supporting member 360 is received in the annular groove 314 of the inlet portion 312 of the casing member 310 and fixedly supported by the inlet portion 312 of the casing member 310. The diaphragm supporting member 360 has a first annular surface 360*a* held in contact with the bottom surface 314*a* of the annular groove 314 of the inlet portion 312 of the casing member 310, and a second annular surface 360*b* opposing and spaced apart along the center axis 311 of the casing member 310 from the first surface 320*a* of the printed circuit board 320. The diaphragm supporting member 360 is made of an electrically conductive material.

The electret condenser microphone 300 further comprises a diaphragm 370 in the form of a circular shape and located between the inlet portion 312 of the casing member 310 and the electrode plate 340 to be held in coaxial alignment with the casing member 310. The diaphragm 370 is mounted on the diaphragm supporting member 360. The diaphragm 370 includes a peripheral portion 371 provided on the second surface 360*b* of the diaphragm supporting member 360 and fixedly supported by the diaphragm supporting member 360, and a central portion 372 integrally formed with the peripheral portion 371 of the diaphragm 370 and radially inwardly extending from the peripheral portion 371 of the diaphragm 370 to be partly oscillatable along the center axis 311 of the casing member 310 with respect to the casing member 310.

The diaphragm 370 has a first circular surface 370*a* opposing and spaced apart along the center axis 311 of the casing member 310 from the second surface 312*b* of the inlet portion 312 of the casing member 310, and a second circular surface 37*b* opposing and spaced apart along the center axis 311 of the casing member 310 from the first surface 340*a* of the electrode plate 340 at a predetermined space distance. The diaphragm 370 is made of an electrically conductive material.

The central portion 342 of the electrode plate 340 is formed with a through bore 345 open at the first and bottom surfaces 340*a* and 344*a* thereof to ensure that the central portion 372 of the diaphragm 370 is partly oscillatable along the center axis 311 of the casing member 310 with respect to the casing member 310.

The electret condenser microphone 300 further comprises an electrically insulating spacer 380 in the form of an annular ring shape and intervening between the first surface 340*a* of the electrode plate 340 and the second surface 370*b* of the diaphragm 370 to have the first surface 340*a* of the electrode plate 340 and the second surface 370*b* of the diaphragm 370 spaced apart from each other at the predetermined space distance. The electrically insulating spacer 380 has a first annular surface 380*a* held in contact with the second surface 370*b* of the diaphragm 370, and a second annular surface 380*b* partly held in contact with the first surface 340*a* of the electrode plate 340 and partly opposing and spaced apart along the center axis 311 of the casing member 310 from the first surface 330*a* of the electrically insulating member 330. The electrically insulating spacer 380 is made of an electrically insulating material.

The electrode plate 340 and the diaphragm 370 collectively constitute a capacitor unit 302 to generate an electrical capacitance corresponding to the space distance between the electrode plate 340 and the central portion 372 of the diaphragm 370 under the state that the acoustic wave is transmitted to the diaphragm 370 to have the central portion 372 of the diaphragm 370 partly oscillated along the center axis 311 of the casing member 310 with respect to the casing member 310.

The electret condenser microphone 300 further comprises a covering member 381 in the form of a circular shape and provided on the first surface 312*a* of the inlet portion 312 of the casing member 310. The covering member 381 is made of a cloth.

The inlet portion 312 of the casing member 310 is formed with a plurality of acoustic apertures 317, 318 and 319 each open at the first and second surfaces 312*a* and 312*b* thereof to have the acoustic wave transmitted to the diaphragm 370 through the covering member 381 and each of the acoustic apertures 317,318 and 319 of the inlet portion 312 of the casing member 310.

The electret condenser microphone 300 further comprises a signal converting unit 390 designed to convert the electrical capacitance generated by the capacitor unit 302 to the acoustic signal indicative of the acoustic wave transmitted to the diaphragm 370. The signal converting unit 390 is accommodated in the casing space 301 of the casing member 310 and provided on the first surface 320*a* of the printed circuit board 320 to be surrounded by the electrically insulating member 330 with a sufficiently large space distance between the printed circuit board 320 and the diaphragm 370. The fact that the signal converting unit 390 is provided on the first surface 320*a* of the printed circuit board 320 to be surrounded by the electrically insulating member 330 leads to the fact that the electrically connecting members 350, 351 and 352 are partly disposed along the circumference surrounding the signal converting unit 390.

The signal converting unit 390 includes a field effect transistor 391, a chip capacitor 392 and a resistor 393. The field effect transistor 391 is the largest in height in the signal converting unit 390 and extends to the circular cavity 344 of the electrode plate 340. The signal converting unit 390 is electrically connected to the electrode plate 340 through the printed wiring of the first surface 320*a* of the printed circuit board 320 and each of the electrically connecting members 350, 351 and 352, and to the diaphragm 370 through the printed wiring of the second surface 320*b* of the printed circuit board 320, the casing member 310 and the diaphragm supporting member 360.

As will be seen from the foregoing description, the third embodiment of the electret condenser microphone according to the present invention makes it possible to reduce the stray capacitance between the casing member and the electrically connecting member, thereby increasing the sensitivity to the acoustic wave, resulting from the fact that the electrically connecting members are partly disposed on and along the circumference of the printed circuit board.

Figure 6:
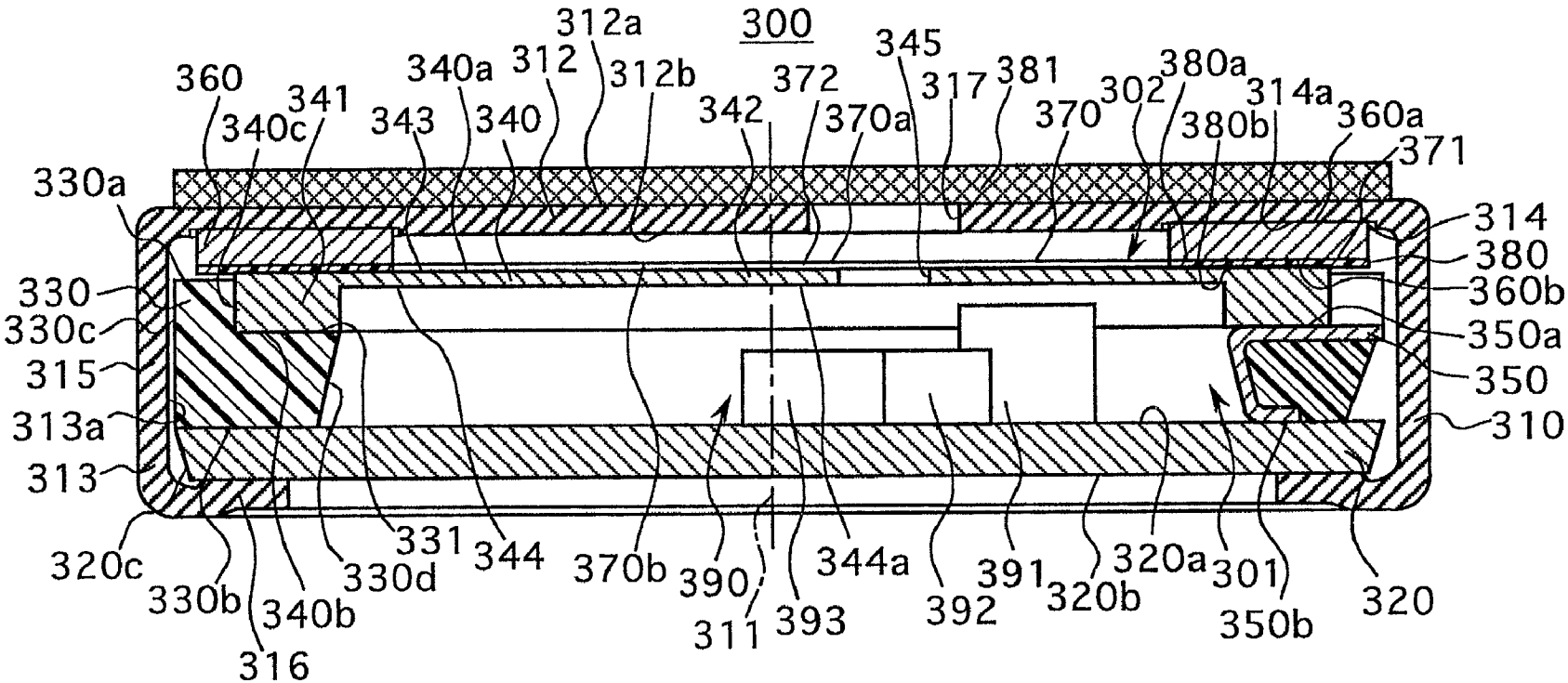
FIG. 6 is a cross-sectional view, taken along the line C—C of FIG. 7, of a third embodiment of the electret condenser microphone according to the present invention.
Figure 7:
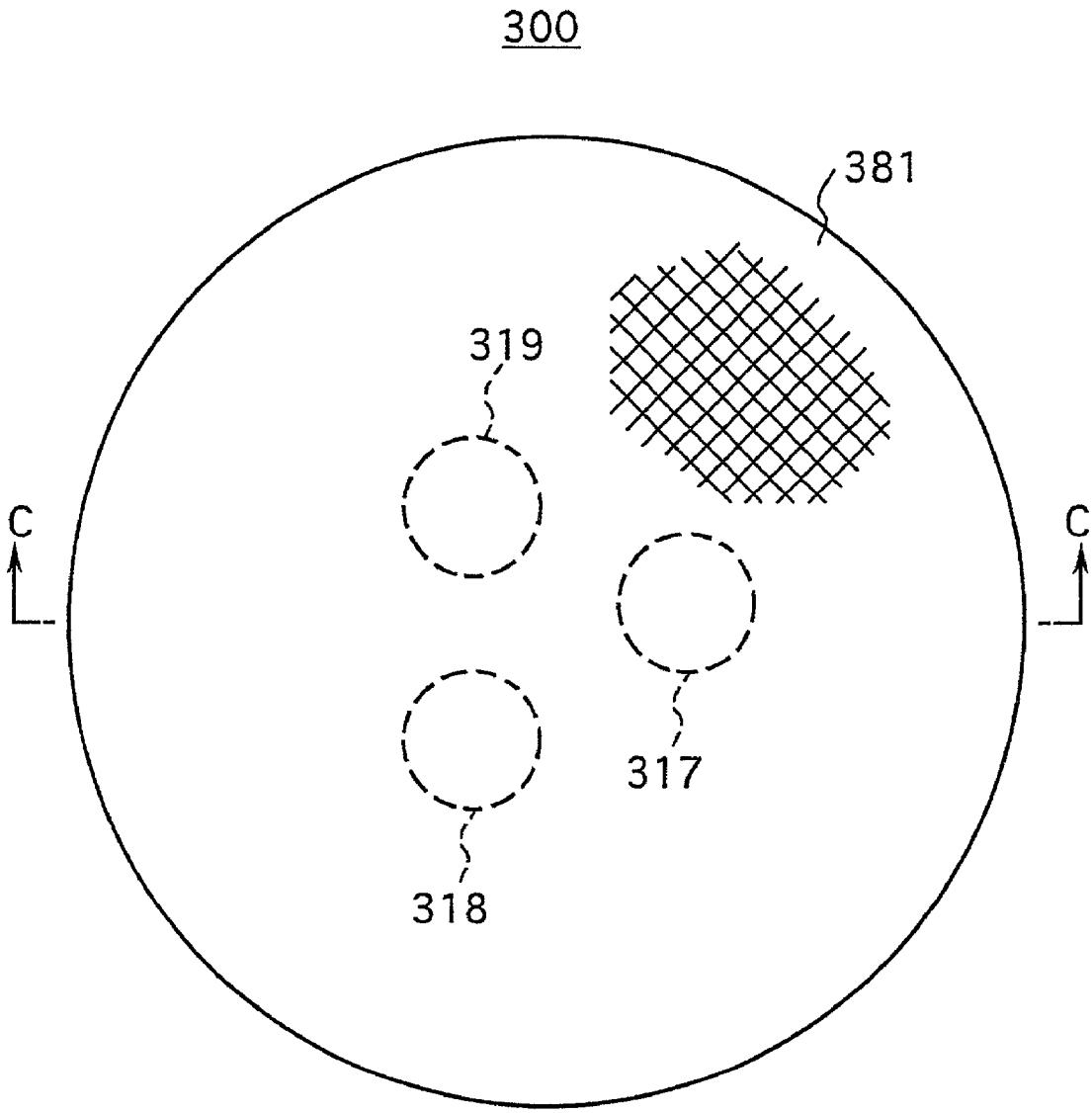
FIG. 7 is a plan view of the electret condenser microphone shown in FIG. 6.
Figure 8:
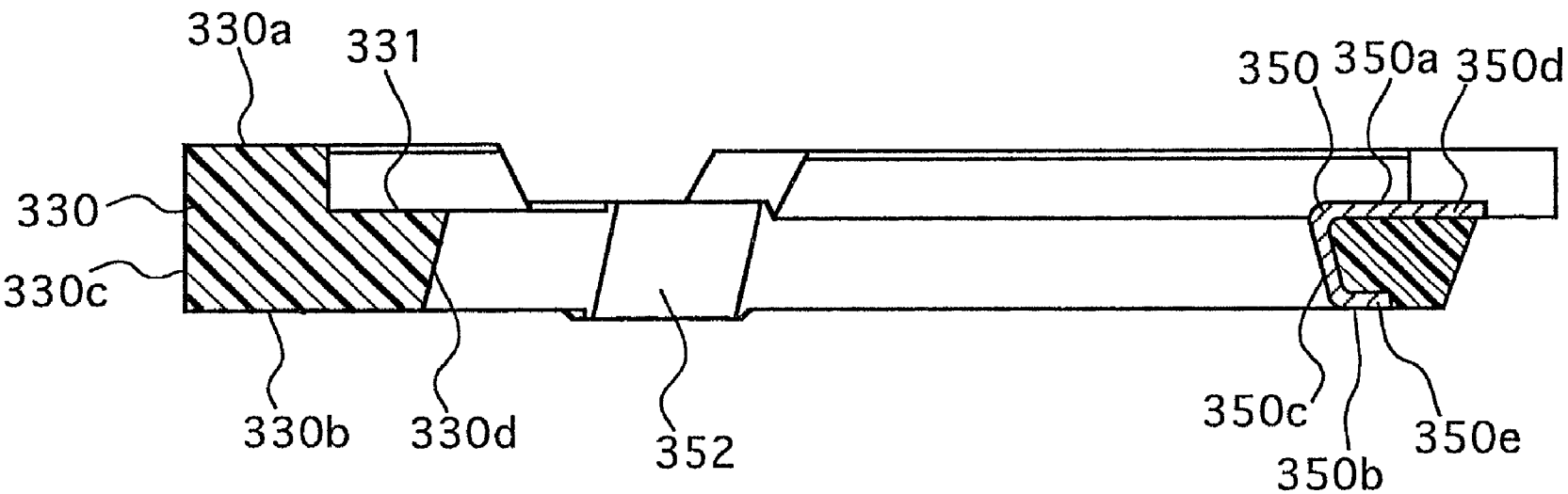
FIG. 8 is a cross-sectional view, taken along the line D—D of FIG. 9, of an electrically insulating member and a plurality of electrically connecting members each forming part of the electret condenser microphone shown in FIG. 6.

While the electret condenser microphone 300 has been described in the above as comprising an electrode plate 340 made of an electrically conductive material and having an electret film 343 on the first surface 340*a* thereof, and a diaphragm 370 made of an electrically conductive material as shown in FIG. 6, the electrode plate 340 and the diaphragm 370 may be replaced by an electrode plate made of an electrically conductive material and a diaphragm made of an electret film according to the present invention.

Figure 10:
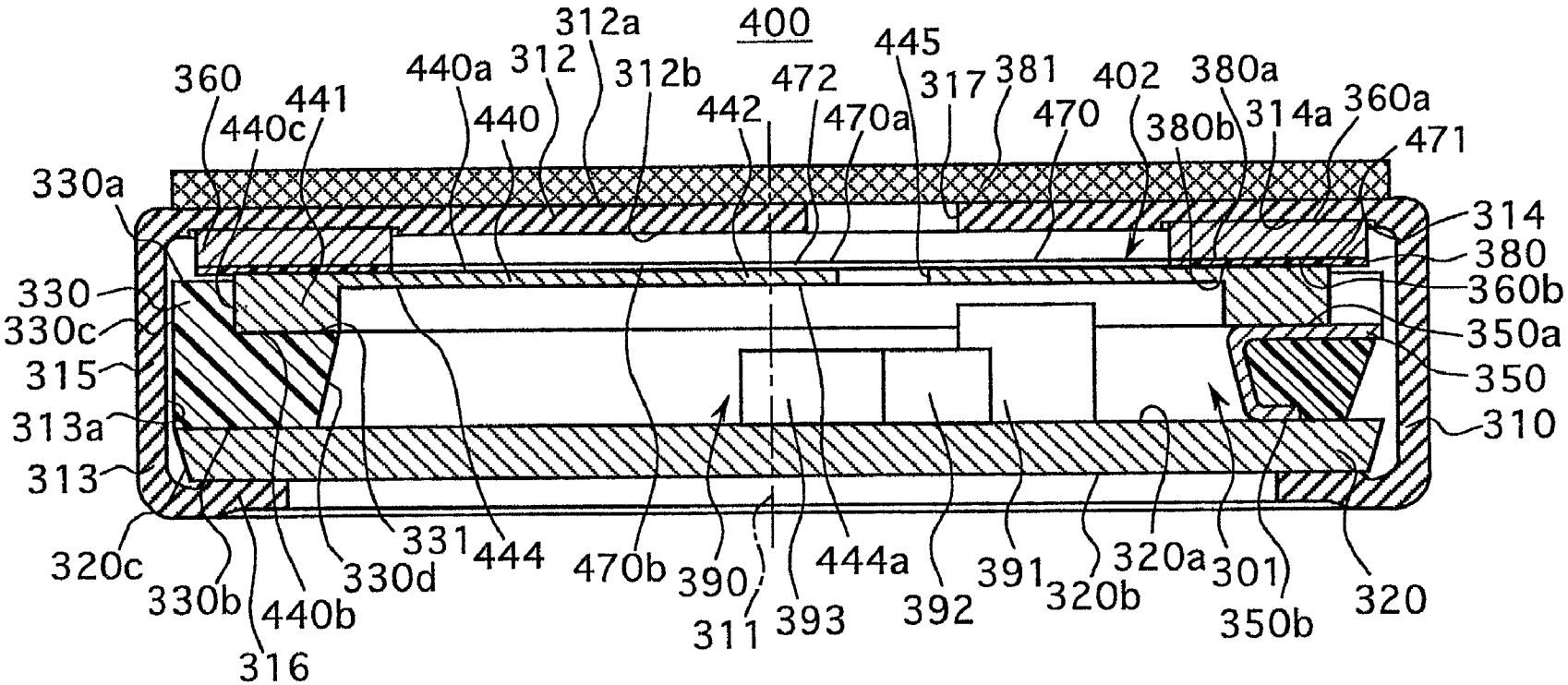
FIG. 10 is a cross-sectional view, taken along the line C—C of FIG. 7, similar to FIG. 6 but showing a fourth embodiment of the electret condenser microphone according to the present invention.

The fourth embodiment directed to an electrode plate made of an electrically conductive material and a diaphragm made of an electret film is shown in FIG. 10.

In FIG. 10, the electret condenser microphone 400 comprises an electrode plate 440 in the form of a circular shape and accommodated in the casing space 301 of the casing member 310 to be held in coaxial alignment with the casing member 310. The electrode plate 440 is mounted on the electrically insulating member 330. The electrode plate 440 includes a peripheral portion 441 received in the annular ledge 331 of the electrically insulating member 330 and securely retained by the electrically insulating member 330, and a central portion 442 integrally formed with the peripheral portion 441 of the electrode plate 440 and radially inwardly extending from the peripheral portion 441 of the electrode plate 440.

The electrode plate 440 has a first circular surface 440*a* opposing and spaced apart along the center axis 311 of the casing member 310 from the second surface 312*b* of the inlet portion 312 of the casing member 310, a second circular surface 440*b* opposing and spaced apart along the center axis 311 of the casing member 310 from the first surface 320*a* of the printed circuit board 320, and a peripheral surface 440*c* spaced apart from the inner surface 313*a* of the side portion 313 of the casing member 310. The electrode plate 440 is formed with a circular cavity 444 open at the second surface 440*b* thereof and having a bottom surface 444*a*. The electrode plate 440 is made of an electrically conductive material.

The electret condenser microphone 400 further comprises a diaphragm 470 in the form of a circular shape and located between the inlet portion 312 of the casing member 310 and the electrode plate 340 to be held in coaxial alignment with the casing member 310. The diaphragm 470 is mounted on the diaphragm supporting member 360. The diaphragm 470 includes a peripheral portion 471 provided on the second surface 360*b* of the diaphragm supporting member 360 and fixedly supported by the diaphragm supporting member 360, and a central portion 472 integrally formed with the peripheral portion 471 of the diaphragm 470 and radially inwardly extending from the peripheral portion 471 of the diaphragm 470 to be partly oscillatable along the center axis 311 of the casing member 310 with respect to the casing member 310.

The diaphragm 470 has a first circular surface 470*a* opposing and spaced apart along the center axis 311 of the casing member 310 from the second surface 312*b* of the inlet portion 312 of the casing member 310, and a second circular surface 470*b* opposing and spaced apart along the center axis 311 of the casing member 310 from the first surface 440*a* of the electrode plate 440 at a predetermined space distance. The diaphragm 470 is made of an electret film. The electret condenser microphone 400 thus constructed is generally called "foil electret type of electret condenser microphone".

The central portion 442 of the electrode plate 440 is formed with a through bore 445 open at the first and bottom surfaces 440*a* and 444*a* thereof to ensure that the central portion 472 of the diaphragm 470 is partly oscillatable along the center axis 311 of the casing member 310 with respect to the casing member 310.

The electrode plate 440 and the diaphragm 470 collectively constitute a capacitor unit 402 to generate an electrical capacitance corresponding to the space distance between the electrode plate 440 and the central portion 472 of the diaphragm 470 under the state that the acoustic wave is transmitted to the diaphragm 470 to have the central portion 472 of the diaphragm 470 partly oscillated along the center axis 311 of the casing member 310 with respect to the casing member 310.

The above description of the fourth embodiment has been made only about the electrode plate 440 and the diaphragm 470 different from those of the third embodiment, but has not been directed to the casing member 310, the printed circuit board 320, the electrically insulating member 330, the electrically connecting members 350, 351 and 352, the diaphragm supporting member 360, the electrically insulating spacer 380, the covering member 381 and the signal converting unit 390 which are entirely the same as those of the third embodiment. Detailed description about the casing member 310, the printed circuit board 320, the electrically insulating member 330, the electrically connecting members 350, 351 and 352, the diaphragm supporting member 360, the electrically insulating spacer 380, the covering member 381 and the signal converting unit 390 will therefore be omitted hereinafter.

It is understood that the fourth embodiment of the electret condenser microphone according to the present invention has an advantage and effect the same as that of the third embodiment of the electret condenser microphone according to the present invention.

While the present invention has thus been shown and described with reference to the specific embodiments, however, it should be noted that the invention is not limited to the details of the illustrated structures but changes and modifications may be made without departing from the scope of the appended claims.

What is claimed is:

1. An electret condenser microphone for receiving an acoustic wave to be converted to an acoustic signal indicative of said acoustic wave, comprising:

a casing member having a center axis passing therethrough, said casing member including a circular inlet portion, and a cylindrical side portion integrally formed with said inlet portion of said casing member, said side portion of said casing member having a first section close to said inlet portion of said casing member, and a second section remote from said inlet portion of said casing member, said second section of said side portion of said casing member being radially inwardly bent toward said center axis of said casing member;

a printed circuit board in the form of a circular shape and disposed in said casing member to be held in contact with said second section of said side portion of said casing member, said casing member and said printed circuit board collectively forming a cylindrical casing space;

an electrode plate accommodated in said casing space of said casing member;

an electrically insulating member in the form of an annular ring shape and accommodated in the casing space of the casing member to be held in coaxial alignment with the casing member;

an electrically connecting member intervening between said printed circuit board and said electrode plate to have said printed circuit board and said electrode plate electrically connected with each other, said electrically connecting member being partly retained by said electrically insulating member and disposed on and along the circumference of said printed circuit board; and a diaphragm located between said inlet portion of said casing member and said electrode plate to be spaced apart along said center axis of said casing member from said electrode plate at a predetermined space distance.

2. An electret condenser microphone as set forth in claim 1, in which said electrically insulating member accommodated is provided on said printed circuit board.

3. An electret condenser microphone as set forth in claim 1, which further comprises a diaphragm supporting member accommodated in said casing space of said casing member and supported by said inlet portion of said casing member, in which said diaphragm is mounted on said diaphragm supporting member and supported by said diaphragm supporting member.

4. An electret condenser microphone as set forth in claim 1, which further comprises an electrically insulating spacer intervening between said electrode plate and said diaphragm to have said electrode plate and said diaphragm spaced apart from each other at said predetermined space distance.

5. An electret condenser microphone as set forth in claim 1, which further comprises a covering member provided on said inlet portion of said casing member.

6. An electret condenser microphone as set forth in claim 1, in which said electrode plate and said diaphragm collectively constitute a capacitor unit to generate an electrical capacitance corresponding to the space distance between said electrode plate and said diaphragm under the state that said acoustic wave is transmitted to said diaphragm to have said diaphragm partly oscillated along said center axis of said casing member with respect to said casing member.

7. An electret condenser microphone as set forth in claim 6, which further comprises a signal converting unit for converting said electrical capacitance generated by said capacitor unit to said acoustic signal indicative of said acoustic wave transmitted to said diaphragm.

8. An electret condenser microphone as set forth in claim 7, in which said signal converting unit is accommodated in said casing space of said casing member and provided on said printed circuit board to be electrically connected to said electrode plate and said diaphragm, respectively.

9. An electret condenser microphone as set forth in claim 7, in which said signal converting unit includes a field effect transistor, a chip capacitor and a resistor.

10. An electret condenser microphone as set forth in claim 1, in which said electrode plate has thereon an electret film opposing and spaced apart along said center axis of said casing member from said inlet portion of said casing member.

11. An electret condenser microphone as set forth in claim 1, in which said diaphragm is made of an electret film.

12. An electret condenser microphone as set forth in claim 1, in which said electrically connecting member is in the form of a column shape and has first and second end surfaces under the state that said first end surface is held in contact with said electrode plate, and said second end surface is held in contact with said printed circuit board.

13. An electret condenser microphone as set forth in claim 1, in which said electrically connecting member is in the form of a channel shape and has first and second end surfaces under the state that said first end surface is held in contact with said electrode plate, and said second end surface is held in contact with said printed circuit board.

14. An electret condenser microphone for receiving an acoustic wave to be converted to an acoustic signal indicative of said acoustic wave, comprising:

a casing member having a center axis passing therethrough, said casing member including a circular inlet portion, and a cylindrical side portion integrally formed with said inlet portion of said casing member, said side portion of said casing member having a first section close to said inlet portion of said casing member, and a second section remote from said inlet portion of said casing member, said second section of said side portion of said casing member being radially inwardly bent toward said center axis of said casing member;

a printed circuit board in the form of a circular shape and disposed in said casing member to be held in contact with said second section of said side portion of said casing member, said casing member and said printed circuit board collectively forming a cylindrical casing space;

an electrode plate accommodated in said casing space of said casing member;

an electrically insulating member in the form of an annular ring shape and accommodated in the casing space of the casing member to be held in coaxial alignment with the casing member;

a plurality of electrically connecting members each intervening between said printed circuit board and said electrode plate to have said printed circuit board and said electrode plate electrically connected with each other, said electrically connecting members being partly retained by said electrically insulating member and disposed on and along the circumference of said printed circuit board to be equidistantly spaced apart from one another; and a diaphragm located between said inlet portion of said casing member and said electrode plate to be spaced apart along said center axis of said casing member from said electrode plate at a predetermined space distance.

15. An electret condenser microphone as set forth in claim 14, in which said electrically insulating member accommodated is provided on said printed circuit board.

16. An electret condenser microphone as set forth in claim 14, which further comprises a diaphragm supporting member accommodated in said easing space of said casing member and supported by said inlet portion of said easing member, in which said diaphragm is mounted on said diaphragm supporting member and supported by said diaphragm supporting member.

17. An electret condenser microphone as set forth in claim 14, which further comprises an electrically insulating spacer intervening between said electrode plate and said diaphragm to have said electrode plate and said diaphragm spaced apart from each other at said predetermined space distance.

18. An electret condenser microphone as set forth in claim 14, which further comprises a covering member provided on said inlet portion of said casing member.

19. An electret condenser microphone as set forth in claim 14, in which said electrode plate and said diaphragm collectively constitute a capacitor unit to generate an electrical capacitance corresponding to the space distance between said electrode plate and said diaphragm under the state that said acoustic wave is transmitted to said diaphragm to have said diaphragm partly oscillated along said center axis of said casing member with respect to said casing member.

20. An electret condenser microphone as set forth in claim 19, which further comprises a signal converting unit for converting said electrical capacitance generated by said capacitor unit to said acoustic signal indicative of said acoustic wave transmitted to said diaphragm.

21. An electret condenser microphone as set forth in claim 20, in which said signal converting unit is accommodated in said casing space of said casing member and provided on said printed circuit board to be electrically connected to said electrode plate and said diaphragm, respectively.

22. An electret condenser microphone as set forth in claim 20, in which said signal converting unit includes a field effect transistor, a chip capacitor and a resistor.

23. An electret condenser microphone as set forth in claim 14, in which said electrode plate has thereon an electret film opposing and spaced apart along said center axis of said casing member from said inlet portion of said casing member.

24. An electret condenser microphone as set forth in claim 14, in which said diaphragm is made of an electret film.

25. An electret condenser microphone as set forth in claim 14, in which each of said electrically connecting members is in the form of a column shape and has first and second end surfaces under the state that said first end surface is held in contact with said electrode plate, and said second end surface is held in contact with said printed circuit board.

26. An electret condenser microphone as set forth in claim 14, in which each of said electrically connecting members is in the form of a channel shape and has first and second end surfaces under the state that said first end surface is held in contact with said electrode plate, and said second end surface is held in contact with said printed circuit board.

* * * * *

UNITED STATES PATENT AND TRADEMARK OFFICE

CERTIFICATE OF CORRECTION

PATENT NO. : 7,031,480 B2
APPLICATION NO. : 09/993416
DATED : April 18, 2006
INVENTOR(S) : Tooru Himori and Yoshinobu Yasuno It is certified that error appears in the above-identified patent and that said Letters Patent is hereby corrected as shown below:

Column 19, Line 6, please delete “easing”, and insert therefor --casing--.

Column 19, Line 7, please delete “easing”, and insert therefor --casing--.

Signed and Sealed this

Nineteenth Day of December, 2006

JON W. DUDAS
*Director of the United States Patent and Trademark Office*